US011351569B1

(12) United States Patent
Lee et al.

(10) Patent No.: US 11,351,569 B1
(45) Date of Patent: Jun. 7, 2022

(54) LIGHTWEIGHT MODULAR APPLICATOR SYSTEM FOR EXTRUSIVE DISPENSING OF WORK MATERIAL HAVING ONBOARD STOWAGE OF ACCESSORY TOOLS

(71) Applicant: PATENT & INVESTMENT LLC, Jessup, MD (US)

(72) Inventors: Albert Lee, Clarksville, MD (US); Brian Glass, West Friendship, MD (US)

(73) Assignee: Patent & Investment LLC, Jessup, MD (US)

( * ) Notice: Subject to any disclaimer, the term of this patent is extended or adjusted under 35 U.S.C. 154(b) by 0 days.

(21) Appl. No.: 17/074,420

(22) Filed: Oct. 19, 2020

(51) Int. Cl.
*B05C 17/005* (2006.01)
*B05C 17/01* (2006.01)

(52) U.S. Cl.
CPC .. *B05C 17/00596* (2013.01); *B05C 17/00576* (2013.01); *B05C 17/0123* (2013.01)

(58) Field of Classification Search
CPC ..... B05C 17/00596; B05C 17/01; B05C 17/00576; B05C 17/0123; B65D 17/00506
USPC ..... 222/325, 391, 326, 327, 392
See application file for complete search history.

(56) References Cited

U.S. PATENT DOCUMENTS 4,461,407 A 7/1984 Finnegan
4,827,557 A 5/1989 Siler, Jr. et al.
5,065,977 A 11/1991 Desjardin
5,413,258 A 5/1995 Kartler
5,595,327 A 1/1997 Dentler
5,638,997 A 6/1997 Hawkins
5,887,765 A 3/1999 Broesamle
D511,445 S 11/2005 Childs et al.
7,073,691 B2 7/2006 Rumrill et al.
7,757,904 B2 7/2010 Rumrill et al.
7,823,753 B2 11/2010 Kovac
8,011,538 B2 9/2011 Herman et al.
8,393,501 B2 3/2013 Herman et al.
(Continued)

FOREIGN PATENT DOCUMENTS

EP 2878383 A1 3/2015
JP H09-150091 A 6/1997

OTHER PUBLICATIONS

Westward Caulk Gun, Drip-Free, Plastic, 10 oz, Revolving Barrel, Mfr. Model # 13J315; https://www.grainger.com/product/13J315 (last visited Jan. 7, 2021).

*Primary Examiner* — Lien M Ngo
(74) *Attorney, Agent, or Firm* — Rosenberg, Klein & Lee

(57) ABSTRACT

A lightweight applicator system is provided for efficient extrusive dispensing of work material from a cartridge. A body of the system includes handle and cartridge frame portions. The handle portion defines a hub structure, which includes at least first and second retention structures. The cartridge frame portion includes a cage member configured for receiving a cartridge of work material, and is releasably coupled to the hub structure in revolvable manner First and second accessory tools are coupled respectively to the first and second retention structures in detachable manner A drive portion is operably coupled to the body, and includes a drive member passing displaceably into the cartridge frame portion for forcing extrusion of work material therefrom. The handle and cartridge frame portions of the body are formed of one or more predetermined nonmetallic materials.

19 Claims, 8 Drawing Sheets

(56) References Cited

U.S. PATENT DOCUMENTS

| | | | | |
|---|---|---|---|---|
| D713,223 | S | 9/2014 | Herman et al. | |
| 8,857,673 | B2 | 10/2014 | Szpak et al. | |
| 8,904,910 | B2 * | 12/2014 | Marsden | B05C 17/00596 83/54 |
| D751,876 | S | 3/2016 | Herman et al. | |
| 9,302,290 | B2 | 4/2016 | Szpak et al. | |
| D788,553 | S | 6/2017 | Hung | |
| 9,776,204 | B2 | 10/2017 | Hung | |
| 10,201,829 | B2 | 2/2019 | Hung | |
| D885,150 | S | 5/2020 | Childs | |
| D885,151 | S | 5/2020 | Childs | |
| 10,722,916 | B2 | 7/2020 | Demeris, Jr. | |
| 2004/0144804 | A1 | 7/2004 | Borisch | |
| 2005/0023301 | A1 * | 2/2005 | Rumrill | B05C 17/0143 222/391 |
| 2013/0161360 | A1 * | 6/2013 | Marsden | B05C 17/0123 222/391 |
| 2018/0318870 | A1 | 11/2018 | Hung | |

* cited by examiner

LIGHTWEIGHT MODULAR APPLICATOR SYSTEM FOR EXTRUSIVE DISPENSING OF WORK MATERIAL HAVING ONBOARD STOWAGE OF ACCESSORY TOOLS

BACKGROUND OF THE INVENTION

The present invention is directed to a system for dispensing and applying an extrudable work material to various work surfaces and areas. More specifically, the present invention is directed to an applicator system that is at least partially formed by modular assembly of certain lightweight, nonmetallic components. The applicator system is also equipped with onboard stowage of certain accessory tools which are of particular utility for the intended use. As such, the applicator system preserves optimal adaptivity and efficacy of work material application, with its lightweight and modularly assembled components minimizing the strain and fatigue of use, and ready yet nonintrusive availability of certain much-used spreading, finishing, or other such accessory work tools thereon.

Various applicator devices for dispensing sealant, adhesive, epoxy, caulk, and other such pasty work materials are known in the art. They include handheld gun-type devices in which a cartridge containing a work material is loaded for engagement by the device's drive mechanism. Such drive mechanism when actuated forces the extrusive flow of work material out of the loaded cartridge and onto a particular work surface or area.

Many application tasks require use of an applicator device over extended periods, frequently with the applicator device manipulated through various positions and orientations to accommodate variations in the work surface or area. Lightweight applicator devices for such situations are known in the art. They often employ various lightweight materials, such as plastic or other non-metallic materials, to lower overall weight and bulkiness, and provide structural features like a trough-shaped cage or frame structures for holding a loaded cartridge instead of a more enclosed barrel-shaped cage or frame to minimize weight. But it is often necessary during use to turn and orient the applicator device to maintain consistency of work material application along a surface. To keep the cartridge securely cradled, the cage/frame is made to be revolvable to keep the open cage/frame substantially upright even if the handle and trigger portions of the device are turned to suit surface variations.

But such applicator devices, however, are typically without the modularity to provide for convenient assembly and disassembly in the field which may be helpful in practice for various reasons. With repeated use of the applicator device over time, for instance, compromises may develop in its structural integrity and overall fit and finish. The repeated flexing of frame components may tend to loosen joints and seams, causing premature wearing of adjoining components with repeated use. Among other things, this may disturb smooth angular displacement of the revolvable cage/frame, either unduly tightening or loosening its intercoupling with interfacing components and surfaces.

Hence, there is a need for an applicator system that may be comfortably operated by users to accurately dispense a work material. There is need for an applicator system having simple, lightweight construction which provides undiminished capabilities dispensing work materials and adapting to various work surface/area configurations. There is a need for applicator systems whose construction not only includes lightweight components, but includes lightweight components which are sufficiently modular for simple and convenient assembly/disassembly in the field by a user. There is a need to extend the modularity to provide for in situ availability of certain well-used accessory tools right there on the applicator devices for on demand access by users without having to set the devices down and retrieve the accessory tools for use in aiding the work material application process.

SUMMARY OF THE INVENTION

It is an object of the present invention to provide an applicator system which may be comfortably operated by users to accurately dispense a work material.

It is another object of the present invention to provide an applicator system which is of lightweight construction without compromised performance in dispensing work materials or adaptivity to various work surfaces and areas.

It is yet another object of the present invention to provide applicator system whose body construction includes lightweight components which are modularly assembled for simple and convenient assembly/disassembly in the field by a user.

It is still another object of the present invention to provide applicator system which provides onboard stowage of a combination of accessory tools for convenient and quick on demand in situ access by a user.

These and other objects are attained by an applicator system formed in accordance with the present invention for efficient extrusive dispensing of work material from a cartridge. The applicator system includes a body having a handle portion and a cartridge frame portion. The handle portion defines a hub structure, which hub structure includes at least first and second retention structures. The cartridge frame portion includes a cage member configured for receiving a cartridge of work material, and the cage member is releasably coupled to the hub structure in revolvable manner. First and second accessory tools are coupled respectively to the first and second retention structures in detachable manner A drive portion is operably coupled to the body, and includes a drive member passing displaceably into the cartridge frame portion for forcing extrusion of work material therefrom. The handle and cartridge frame portions of the body are formed of one or more predetermined nonmetallic materials.

In certain embodiments, the applicator system provides for at least the first retention structure to include a receiving post protruding from the hub structure for snap fit engagement by the first accessory tool when stowed thereon.

In certain other embodiments, the applicator system provides for at least the second retention structure to include a pocket structure for receiving partially enclosed retention of the second accessory tool therein when stowed.

In still other embodiments, the applicator system provides for a retentive stop member to be formed on the hub structure displaced from the second retention structure for blocking the second accessory tool from escaping engagement with the second retention structure when stowed.

DETAILED DESCRIPTION OF THE PREFERRED EMBODIMENTS

Figure 1:
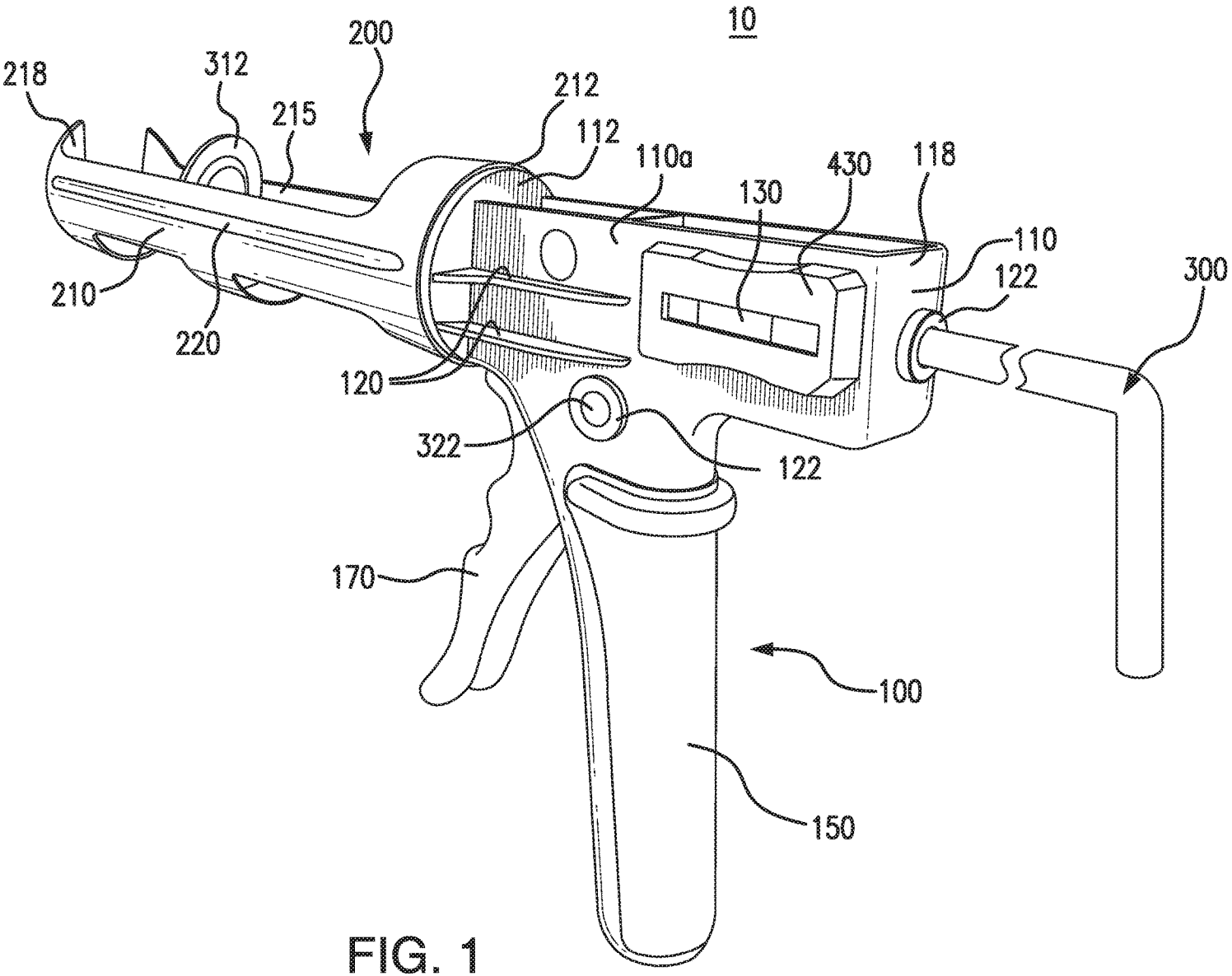
FIG. 1 is a left rear side perspective view of a system formed in accordance with one exemplary embodiment of the present invention.
Figure 2:
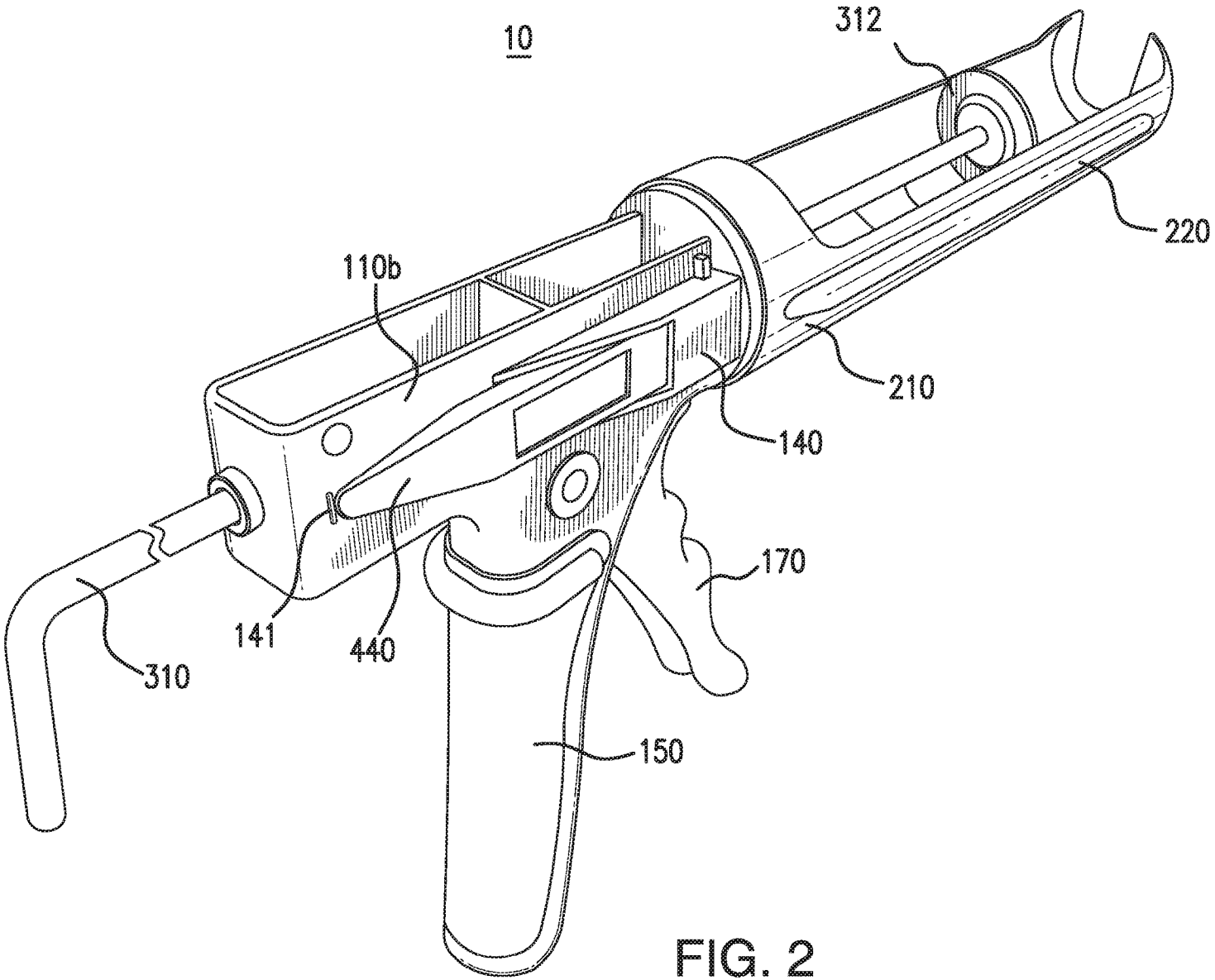
FIG. 2 is a right upper rear side perspective view of the embodiment of FIG. 1.

Referring now to FIGS. 1-6, there is illustratively shown a lightweight modular applicator system 10 formed in accordance with one exemplary embodiment of the present invention. Briefly, the applicator system 10 is configured such that it may be loaded securely with one or more cartridges (not shown) of any suitable type known in the art containing a particular work material. Once loaded, the applicator system 10 may be actuated to force extruded dispensing of the work material from the cartridge onto a work surface (or area). The applicator system 10 is generally constructed to minimize overall weight and bulk, while preserving the structural properties required for maximum transfer of energy to drive such extruded dispensing. The applicator system 10 is suitably constructed to maintain stable support and secure retention of the cartridge loaded therein during operation.

In the embodiment shown, the applicator system 10 is configured to accommodate a cylindrical cartridge of a type often employed in the art. In alternate embodiments, of course, applicator system 10 may be configured to suitably accommodate cartridges of various other type, and system 10 is not limited to any cartridge type in particular. The cartridge contains one or more work materials within a tubular cylinder having a circular or other sectional contour. Many cartridges employed in the art are typically provided at their front ends with a tip which is cut open to provide a dispensing nozzle, and provided at their rear ends with a displaceable plunging disk that may be axially driven forward to force the work material out through the dispensing tip.

Various lightweight materials known in the art which may be used in fabricating applicator system 10 provide for sufficient combination of strength and rigidity for intended applications. For certain though not all applications, they me be of higher density compositions. Viable lightweight materials generally include various plastic, fiberglass, and other non-metallic materials, which offer varying degrees of overall strength and rigidity. Depending on the particularly intended embodiment and application, structural configuration features may be used to offset deficient material properties. For example, where a particular material might otherwise lack the intrinsic rigidity needed for a particular application, the deficiency may be offset by structural features configured to add compensatory bulk or reinforcement at strategic portions to resist deflection.

The applicator system 10 is preferably constructed with a body which generally incorporates framework configurations and structural features in suitable degree to eliminate excess weight, and does so without incurring undue loss of strength and rigidity in the resulting structure. That is, the applicator system 10 is constructed to exhibit a level of stiffness preferably meeting or exceeding that of other applicator devices known in the art, approaching that of devices formed largely or entirely of metallic or other such hard, high density materials. The applicator system 10 is so constructed to sufficiently withstand the load of typical driving forces applied to the cartridge held therein without undue deflection.

The applicator system 10 is preferably formed in the disclosed embodiment with a body that is formed of lightweight nonmetallic material construction, with the possible exception of certain mechanical hardware such as drive rods, springs, drive plates, pivot shafts, joint linkages, or the like to the extent they are employed. The body may include portions/components formed of the same or different nonmetallic materials, depending on the requirements of the particularly intended application. Where multiple nonmetallic materials are employed, that portion or component of the body which primarily and most directly bears driving loads is preferably formed of a material of greater rigidity (even if relatively heavier in weight), while the remaining portion(s) or component(s) is formed of one or more other materials which are lighter, if less rigid. Such primary load bearing portion/component is configured structurally such that it tends to isolate and distribute the drive load within itself, thereby maintaining stiff support against the applied load.

The applicator system 10 generally comprises a body generally formed by a handle portion 100 and a cartridge frame (or cage) portion 200. The applicator system 10 comprises as well a drive hardware portion 300 operably coupled to the body, which includes a drive member 310 displaceable relative to the body. The drive member 310 when driven applies a drive force on the cartridge held by the cartridge frame portion 200 to force the extrusion of work material therefrom.

As described in preceding paragraphs, the body is preferably formed in the exemplary embodiment shown with a lightweight structure assembled from lightweight nonmetallic components. Preferably, at least the handle frame portion 100 and the cartridge frame portion 200 are formed respectively of a suitable hard plastic, rubber, and/or other suitable nonmetallic material known in the art. Different combinations of suitable nonmetallic materials may be employed for the body to optimize or otherwise 'tune' its strength and stiffness. Additional structural measures are preferably taken to minimize the weight of each portion 100, 200 of the body, as illustrated by the skeletal, open, or hollowed out configurations preferably employed.

All or parts of the drive hardware portion 300 may likewise be formed of suitably dense, strong, and rigid nonmetallic materials. But in most applications, formation of such parts may be prohibitively expensive, and such parts may be formed conventionally of suitable metallic materials to affordably realize the required degree of density, strength, and rigidity.

The cartridge frame portion 200 is preferably formed with a cage member 210 which is securely coupled to the handle portion 100 to project forward longitudinally therefrom. The cage member 210 is preferably formed with a skeletal, open structure, such as the open and generally trough-like shaped structure shown, which defines a compartment 215 suitably shaped and dimensioned to receive a given cartridge of work material. The cage member 210 configuration shown illustrates but one of numerous examples of the shape and configuration that the structure may take, depending on the particular requirements of the intended embodiment and application.

The cage member 210 is preferably formed with one or more reinforcing ribs 220 is integrally formed to extend longitudinally therealong. The reinforcing ribs 220 augment the overall rigidity of the cage member 210, helping to compensate some of the strength and rigidity lost with the would be wall surfaces shed by its skeletal construction.

Like the cartridge frame portion 200, the handle portion 100 is preferably also formed of a lightweight nonmetallic material. As compared to the cartridge frame portion 200, however, the handle portion 100 may—though not necessarily—be formed of a relatively lesser weight material which need not be as strong or rigid. The handle portion 100 is not subject to the same primary driving load which the cartridge frame portion 200 bears when the drive member 310 is driven to advance into the cartridge loading compartment 215 against the cartridge held there. As such, the handle portion 100 in the illustrated embodiment may be formed of a nonmetallic material that affords even more weight savings than the material composition of the cartridge frame portion 200.

The handle portion 100 includes a hub structure 110 from which a handle, or grip, member 150 extends as shown. The handle portion also includes a trigger member 170 pivotally coupled by a pivot member 322 to an upper part of the handle member 150 (at or near the hub structure 110) for pivotal displacement thereabout. As noted, the different members/parts making up the handle portion 100—except perhaps linkage hardware such as the pivot member 322—are preferably also formed of lightweight nonmetallic material with a skeletal configuration. For example, the hub structure 110, grip member 150, and trigger member 170 are each molded or otherwise shaped and contoured in formation to describe generally shell-like, or hollowed out structural components.

The hub structure 110 serves as the main housing for the assembly of drive mechanism hardware implementing the drive portion 300. The hub structure 10 is formed to define one or more compartments to house any suitable type and combination of drive mechanism hardware (not shown) known in the art utilized for a given embodiment and application, and the present invention is not limited to any particular type or combination. Such drive mechanism hardware housed by the hub structure 110 may include, for example, a ratcheting or other suitable mechanism known in the art for retractably advancing the drive member 310 into the cartridge loading compartment.

The hub structure 110 extends longitudinally from a forward end which defines a support plate 112 to an aft end which defines a back wall 118. The support plate 112 defines a forward directed surface against which the bearing surface 212 of the cage member 210 is engaged for modular assembly of the cartridge frame portion 200 to the handle portion 100. Toward that end, the handle portion 100 preferably also includes a nut washer 126 which, as described in following paragraphs, releasably captures the cage member 210 in angularly displaceable manner against support plate 112 of the hub structure 110.

The hub structure 110 defines at least first and second support surfaces 110*a*, 110*b* on which first and second accessory retention structures are respectively formed for stowage of first and second accessory tools. The accessory retention structures are arranged and configured on the hub structure 110 to provide ample clearance for a user's free handling and manipulation of the applicator system 10 while maintaining stable and sure securement for the accessory tools. Oft-used tools such as material spreaders, scrapers, or are made immediately available during use in unobtrusive and safely secured manner.

The hub structure 110 as shown is formed with forward and aft openings to accommodate the passage of the drive member 310 longitudinally therethrough and into the cage member 210. The hub structure is preferably formed with one or more reinforcing flanges 120 formed, for instance, to stabilize the support plate 112 relative to the outer surfaces of the hub structure 110. As shown, the hub structure is preferably also formed with one or more collar ridges 122 formed about respective through openings/passages in a wall of the hub structure to reinforce against compromising wear due to the passage of corresponding members therethrough (such as drive or pivot members).

Figures 5, 5A:
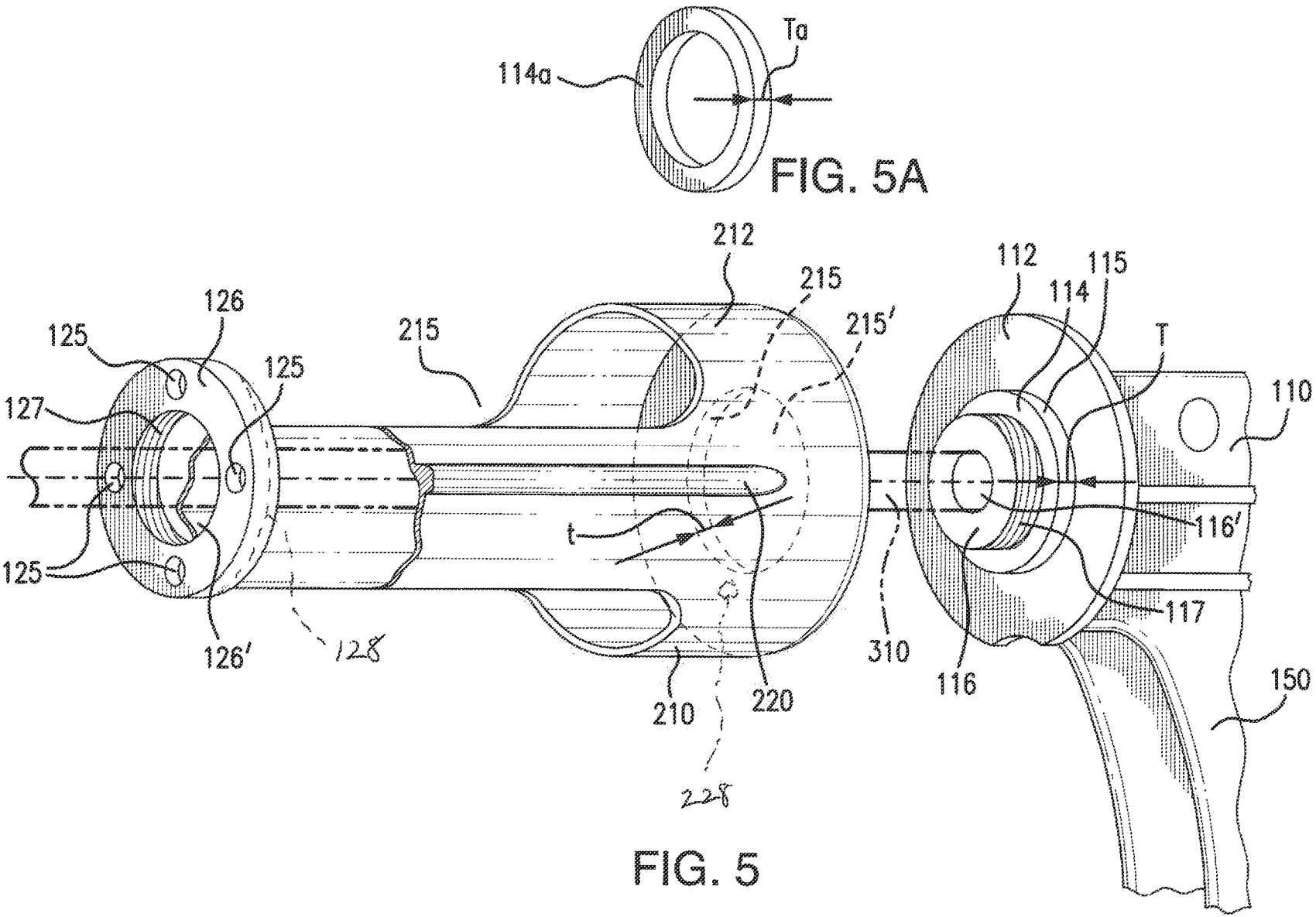
FIG. 5 is an enlarged exploded perspective view of a portion of the embodiment of FIG. 1, partially cut away, illustrating a detachable coupling of a cage member to a hub structure of the system.
FIG. 5A is an isolated view of a discrete shoulder component portion of the system formed in accordance with another alternate embodiment of the present invention.
Figure 6:
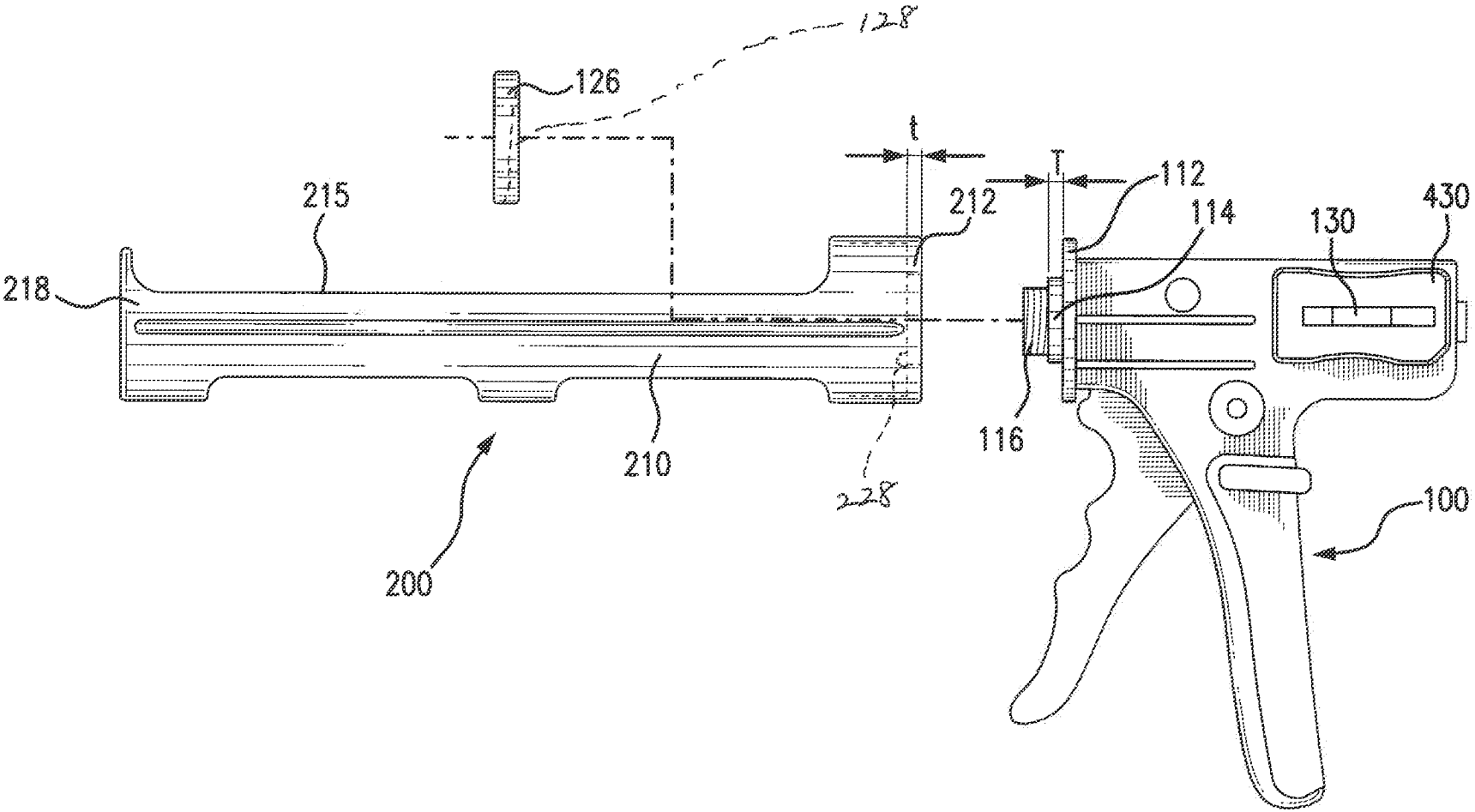
FIG. 6 is an exploded elevation view of body of the system formed in the embodiment of FIG. 1.

Referring to FIGS. 5-6, the forward end of the hub structure 110 is formed with a stem 116 which projects coaxially (in the longitudinal direction) from a ring-shaped shoulder 114 raised from the planar surface defined by the support surface 112. The stem 116 forms a central bore 116' which continues axially through the shoulder 114 and support surface 112 to open communication theretherough between the cartridge receiving compartment 215 of the cage member 210 and the hardware housing compartment of the hub structure 110. The bore 116' is sized to coaxially pass the drive member 310 therethrough to slidably advance and drive extrusive dispensing of work material from the cartridge. The stem 116 is preferably formed in the illustrated embodiment with an external threaded surface 117.

The nut washer 126 is formed with a central opening 126' through which it coaxially receives the stem 116. An inner annular surface 126' which defines the central opening 126' is formed with a complementary internal threaded surface 127 for coaxial threaded engagement of the stem 116 thereabout. To facilitate tool access for tightening and untightening onto and off of the stem 116, an outer longitudinally directed face of the nut washer 126 is formed with one or more openings, recesses, or other such structural features 125 defining catch points which a user may easily engage with a screw driver or other tool to turn the nut washer 126 on the stem 116 much as turn a rotary dial about its central shaft.

The cage member 210 extends longitudinally (or coaxially with the drive member 310 and cartridge) between a bearing plate 212 formed at its rear end and a front cap 218 formed at its front end. The front cap 218 is suitably configured to firmly retain and support the front of the cartridge when received in the compartment 215. As shown, it is preferably formed to define a substantially U-shaped notch or other suitable structure such that it may block the front end of the cartridge against release while providing cradled support for the front dispensing tip emerging from the cartridge.

The bearing plate 212 of the cage member 210 is formed with a central opening 215' sized to be slightly greater in diameter than the shoulder 114 of the hub structure 110 to receive the same in snug yet slidable manner. The bearing plate 212 forms a smooth inner annular surface 215 about the opening 215' which defines a thickness t in the axial direction of the stem 116. The shoulder 114 conversely forms a smooth outer annular surface 115 which defines a thickness T in the axial direction of the stem 116.

As schematically illustrated in FIGS. 5-6, the cage member 210 is releasably captured against the hub structure 110 by the nut washer 126. More specifically, the nut washer 126 is coaxially onto the stem 116 and threadedly advanced thereon to capture the rear bearing plate 212 of the cage member 210 retentively against the support plate 112 of the hub structure 110. This is preferably not a tight capture against the support plate. Rather, it is a snug yet loose enough capture of the bearing plate 212 against the support plate 112, such that the cage member 210 as loaded with a cartridge may be rotated about (or revolve around) the axis of the drive member passing through the bore 116' to be freely adjusted in angular position relative to the hub structure 110, hence relative to the handle portion 100. But the capture is tight enough that that the cage member 210 as loaded with a cartridge cannot hold (remain in) its set angular position relative to the handle portion 100 when the applicator system 10 is subjected to normal handling and manipulation during use.

The degree of tightness by which the cage member 210 is revolvably captured against the hub structure 110 may be regulated—or effectively tuned—by suitably configuring the relative thicknesses T and t of the bearing plate's inner annular surface 215 and shoulder's outer annular surface 115. Thickness T represents the size of the gap resulting between the nut washer and the support plate 112 when it is fully advanced/tightened onto the stem 116, and thickness t represents the portion of that gap filled by the bearing plate 212. In the embodiment shown, the bearing plate's thickness t is very slightly less than the shoulder's thickness T. Consequently, when the nut washer 126 is fully tightened on the stem 116 an cannot be threadedly advanced any further, this difference in thicknesses T and t provides a slight clearance for the cage member 210 to remain snugly, though not loosely, revolvable relative to the hub structure 110. That is, the bearing plate 212 has the clearance to slide against the support plate 112 when manually turned but maintains enough frictional contact/engagement with surrounding surfaces to withstand the natural torque due to gravitational forces thereon during normal handling and manipulation of the applicator system 10.

The ratio t/T may be varied to accordingly vary, or tune, the cage member's ease of angular adjustment to a desired degree with respect to the handle portion 100. This ratio may be preset (built in) at initial fabrication of the applicator system 10, or it may in certain embodiments be adjustable using suitably configured measures. For example, different frame cartridge frame portions 200 (or just their cage members 210) may be modularly offered with different bearing plate 212 thicknesses t to match interchangeably with the same handle portion 100 (or just its hub structure 110). Alternatively, different handle portions 100 (or just their hub structures 110) may be modularly offered with different shoulder 114 thicknesses T to match interchangeably with the same frame cartridge frame portion 200 (or specifically just its cage member 210). A selective tuning capability may be provided for a user thereby.

In other embodiments, the shoulder 114 may be implemented as a discrete separable component which is removably coupled about the stem 116, much like a removable spacer or washer to stop axial advancement of the nut washer 126 on the stem 116. While it may not provide as stable a fit as a shoulder 114 that is integrally formed or otherwise fixedly provided at the base of the stem 116 as in the illustrated embodiment, a removable shoulder component 114 would provide a simple and economic way of reconfiguring/tuning the applicator system 10 in this regard—by simply swapping out for differently configured yet interchangeable shoulder components 114.

FIG. 5A illustrates one example of a discrete shoulder component 114*a* which may be employed either as a supplemental gap extender to a fixed shoulder 116 as shown, or as a replacement for a removable shoulder component in certain alternate embodiments. The thickness Ta would be determined in view of the requirements of the particularly intended embodiment and application, so as to either extend or set the gap size occupied by the bearing plate 212. For example, if the shoulder component 114*a* were employed as a supplemental gap extender, the thickness Ta may be set to a fraction of the existing shoulder's thickness T in axial thickness though matching its diametric dimension to otherwise conform to the existing shoulder 114 closely. If the shoulder component 114*a* were employed as a replacement for a removable shoulder component 114, the thickness Ta may be set to any suitable axial thickness greater or less than thickness T of the original shoulder component 114, or even equivalent to thickness T (if used as simple replacement for that original shoulder component 114).

Whether a removable shoulder component 114*a* or fixed shoulder 114 is employed, the degree of tightness by which the cage member 210 is revolvably captured against the hub structure 110 may be variably provided in certain alternate embodiments for ready adjustments as needed by the user without disassembly of any components. This may be implemented, for example, by a combination of a helically sloped face formed on one of the longitudinally directed faces of the nut plate 126 or the given shoulder 114*a*, 114 between which the cage member's bearing plate 212 is revolvably captured, and a protruding spacer nub formed on the immediately opposing side of the bearing plate 212. This is may be illustrated with reference to FIGS. 5-6, where the clearance provided for the back bearing plate 212 by the thickness T or Ta of the given shoulder 114*a*, 114 is set to be fairly tight.

The clearance may be gradually expanded, for instance, by helically sloping the annular longitudinally directed face of the nut washer 126 around the annular loop that it defines (as schematically indicated by the phantom profile 128), or along one or more segments of that loop. A protrusive spacer nub 228 (as schematically indicated in phantom) may be formed on an inner side of the bearing plate. The sloped/inclined portion 128 of that annular face may be configured in such alternate embodiment to gradually draw away from immediately opposing side of the bearing plate 212. So when the cage member 210 is rotated to displace its protrusive nub 228 from one region of the sloped portion 128 it bears loosely (if at all) against sloped portion 128 where it is drawn farther away, and bears more tightly against that sloped portion 128 where it is drawn closer. The cage member's tightness of capture may then be increased or decreased by turning between one angular position to another relative to the handle portion 100, such that it is held tighter, for example, as it is turned to angular positions that deviate farther away from an upright vertical orientation with respect to the handle portion 100.

In a converse configuration, the sloped/inclined surface may be formed instead on the longitudinally directed face of the given shoulder 114*a*, 114, and the protrusive spacer nub formed on an outer side of the bearing plate 212. In that case, the opposing annular face of the nut washer 126 may be formed as in the illustrated embodiment to define simply a flat planar profile, yet the graduated tightening effect may be realized by the interaction of the protrusive spacer nub and sloped/inclined surface at the shoulder side.

Although not shown, the applicator system 10 is preferably though not necessarily equipped in the illustrated embodiment with a cleanout/poker tool (not shown), which may be extended and used for axially penetrating the dispensing tip of the given cartridge to remove residual material therefrom and perforating a membrane seal for initial access to the work material. The cleanout tool may be coupled (either detachably or displaceably mounted) at a suitable part of the either the handle portion 100 or cartridge frame portion 200. For example, the cleanout tool may be coupled by a pivot member enabling the tool to swing in angularly displaceable manner between active use and stowed positions.

The detachable coupling between the cartridge frame portion 100 and the handle portion 100, and preferably also between the grip 150 and hub structure or trigger 170 of the handle portion 100 advantageously provides a useful measure of modularity for the body of the applicator system 10. As would be apparent to one of skill in the art, such modularity affords flexibility and economy both in the manufacture of system 10, and in its use in the field. In the field, for instance, differently configured components (such as discrete shoulder components 114*a*) may be carried by a user to quickly and conveniently substitute for existing components where necessary to adapt the system 10 for optimal performance at a particular work project. Spare components identically configured to original components may be carried as replacements for simple and convenient replacement in the event of the original components are damaged or disabled (i.e., clogged with gunk) during use, or are excessively worn with use.

The drive portion 300 employs in the illustrated embodiment a drive mechanism manually powered by user actuation to extrusively dispense the work material onto the given work area. Depending on the intended application, the applicator system 10 may alternatively employ a drive mechanism of power assist type (either partially or fully), where user activation of a trigger or button control actuates a power-assisted, automatic drive of the dispensing process. But the various power assist mechanisms known in the art—such as pneumatic, hydraulic, electro-mechanical, electro-magnetic, or the like—are likely to add too much weight and complexity to be a viable option in many (though not necessarily all) applications.

The drive portion 300 may be of any suitable type known in the art. As such, the drive portion 300 may employ any suitable type of drive mechanism. For example, a ratcheting type mechanism may operate on the drive member 310 that passes displaceably through the hub structure 110. The drive portion 300 in the embodiment shown is configured to operate responsive to the trigger 170 of the handle portion 100, which is coupled by a pivot member 322 to an upper part of the handle 150 for pivotal displacement thereabout. In this embodiment, the trigger 170 is preferably biased by a spring or other resilient member (not shown) to be displaced outward from the handle 150. Once it is squeezed toward the handle 150 for one pull stroke, the trigger 170 is automatically returned for squeezing in a further pull stroke. With each pull stroke, the ratcheting drive mechanism incrementally advances then holds the drive member 310 further into the cartridge loading compartment 215, against the cartridge loaded there.

While the given drive mechanism is suitably housed within the hub structure 110 as described herein, the present invention is not limited to any particular choice of drive mechanism type, nor to any particular choice of structure and configuration for that drive mechanism. Hence, the drive portion 300 is not described in further detail.

Regardless of how the cartridge frame portion 200 is particularly configured, it must maintain sufficient rigidity and overall frame stiffness under the load of the drive forces imparted by the drive portion 300 during use. When the drive member 310 is driven longitudinally forward during use, its plunger disk 312 bears against the back end of the loaded cartridge and urges the same forward towards and against the front cap 218 of the cage member 210. The open cage structure illustrated for the cage member 210 must not give way to flexing under the resulting load force. To ensure that the cage member 210 remains stiff enough to maintain a substantially undeflected shape under load, it is preferably formed with one or more reinforcing ribs 220 along its outer surfaces. The rib(s) 220 may be formed with any dimension, shape, or other configurational feature suitable for the intended embodiment and application, and on any suitable surface of the cage member 210 where it would stay clear of the loaded cartridge or operation of the drive portion 300.

For efficient operation of the applicator system 10, the drive energy must be efficiently delivered to the loaded cartridge. This requires the cartridge to be held in proper longitudinal alignment within the cartridge loading compartment 215, as energy transferred into the compartment it would be largely wasted otherwise. So the cartridge must remain sufficiently supported by the cage member 210 to avoid misalignment with the drive member 310, such that the cartridge's plunging disk may be pushed straight in for proper extrusion of the work material therefrom. Otherwise, the operational seal between the plunging disk and surrounding portions at the rear end of the cartridge could be disrupted, and a messy leak of the work material could occur. Hence, the cartridge frame portion 200 employs a cage member 210 suitably configured to define a trough like cradle structure to stabilize a loaded cartridge with excess weight-inducing material 'cut away.'

In accordance with certain aspects of the present invention, the applicator system 10 is equipped with a plurality of onboard stowage measures for a plurality of accessory tools that a user may often require during typical use of the system 10. This would preferably be in addition to the cleanout/poker tool that the system 10 may also be equipped with. The actual type and configuration of such accessory tools may vary depending on the given embodiment and the particularly intended applications; and, two illustrative examples are incorporated in the embodiment shown. One accessory tool 430 is stowed at one part of the system's handle portion 100 via a snap on type retention structure, while another accessory tool 440 is stowed at another of the system's handle portion 100 via a holster, or pocket, type retention structure. These are but examples of the accessory tool types which may be stowed by the applicator system 10, which may be provided in certain alternate embodiments to stow types of accessory tools other than those shown, using different combinations of retention structures other than that shown.

The retention structures 130, 140 are preferably formed on the handle portion's hub structure 110, preferably though not necessarily formed integrally of the same strong and rigid yet lightweight nonmetallic material as that hub structure 110. Each retention structure 130, 140 is configured, positioned, and arranged on a part of the hub structure 110 that would remain well out of the way as the user grips, lifts, supports, actuates, and/or maneuvers the applicator system 10 during typical use. The retention structures 130, 140 are thus configured and disposed to keep the accessory tools 430, 440, when stowed, well clear of the user's normal handling and manipulation of the applicator system 10 during typical use, while consistently maintaining a readily accessible yet firmly supported retention of such accessory tools.

In the illustrated embodiment, the first accessory tool 430 is of a finishing tool type for finely shaping and spreading a bead of caulk or other material shortly after it is dispensed by the applicator system 10. Like similar finishing tools known in the art, this accessory tool 430 is formed with different peripheral sections which define differently shaped spreading edges to offer a range of available spreading shape options on the same tool. A snap-on type retention structure 130 is provided in the form of a protruding socket, or post, on a substantially flat side surface 110*a* of the hub structure 110. The accessory tool 430 is formed with a receptacle 432 for snap-fit engagement with the post 130.

Figure 3A:
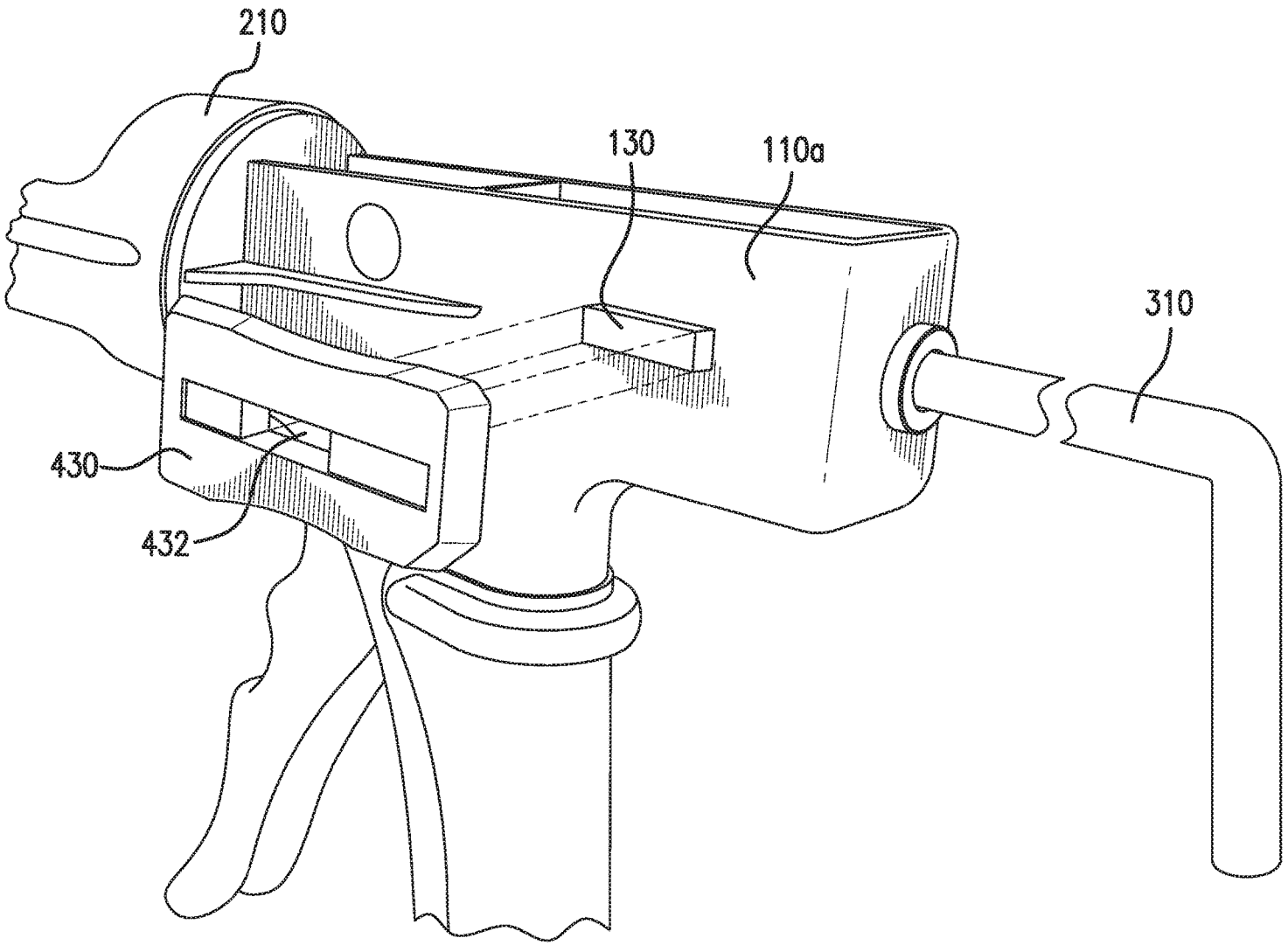
FIG. 3A is an enlarged exploded perspective view of the embodiment as shown in FIG. 1, partially cut away.
Figure 3B:
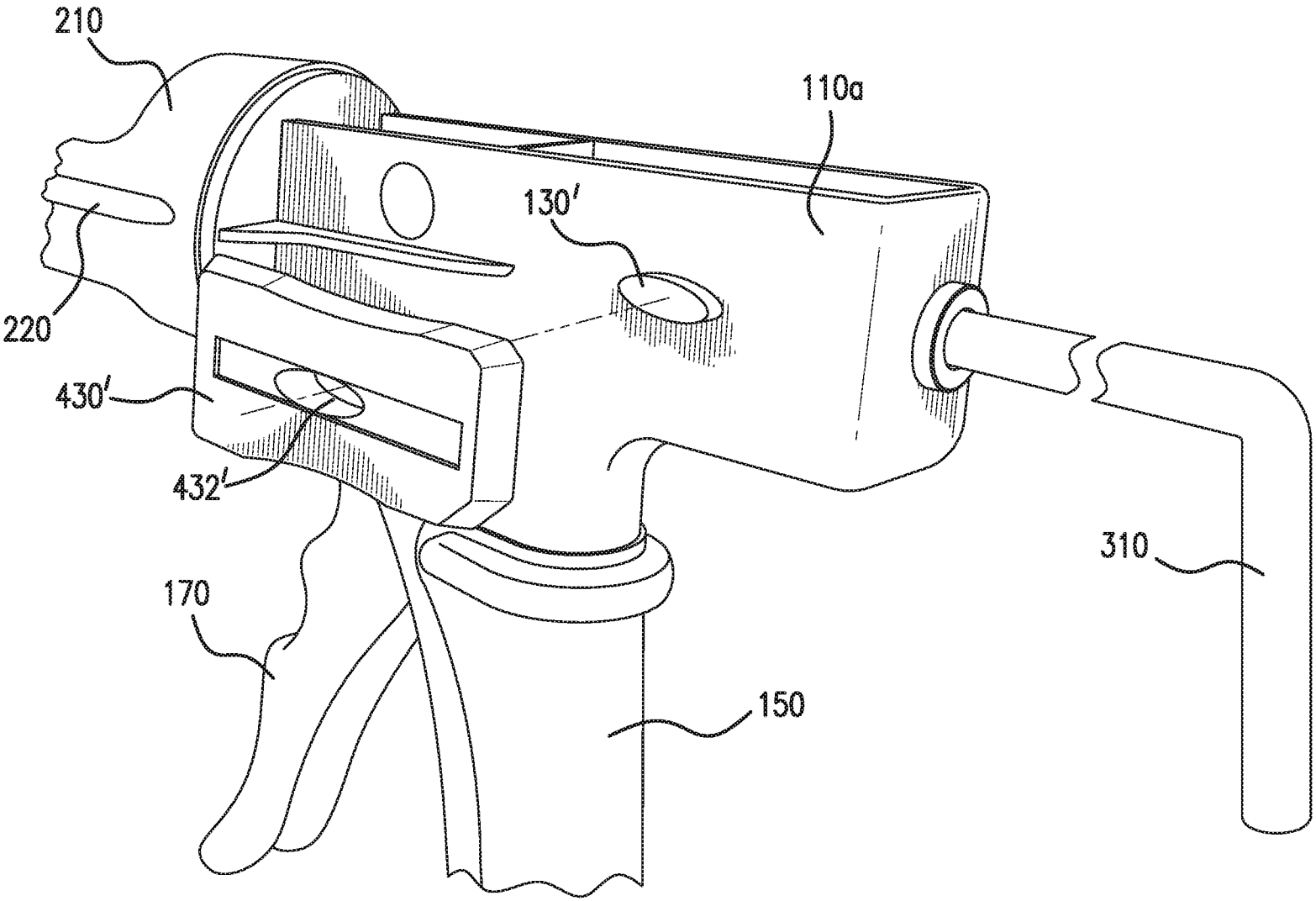
FIG. 3B is an enlarged exploded perspective view, partially cut away, of a system formed in accordance with an alternate embodiment of the present invention comparatively shown with reference to the embodiment shown as shown in FIG. 3A.

As shown in FIG. 3A, the receptacle 432 is formed in the illustrated embodiment as a simple through opening. In alternate embodiments, the receptacle 432 may be formed otherwise, such as by a recess or other complementary structure for retentively receiving post 130. The rectangular shape of the opening 432 and receiving post 130 illustrate but one of numerous examples of the shapes and forms that these cooperatively engaging features may take on. As illustrated in the alternate embodiment of FIG. 3B, for instance, the opening 432 and receiving post 130 may be formed to define an oval, oblong, or other such shape, so long as the cooperative engagement provides secure hold during typical use of the applicator system 10 while being readily removable by a user simply drawing the accessory tool 430 up off the retention/receiving post 130.

In the illustrated embodiment, the first accessory tool 430 is of a finishing tool type for finely shaping and spreading a bead of caulk or other material shortly after it is dispensed by the applicator system 10. Like similar finishing tools known in the art, this accessory tool 430 is formed with different peripheral sections which define differently shaped spreading edges to offer a range of available spreading shape options on the same tool. A snap-on type retention structure 130 is provided in the form of a protruding socket, or post, on a substantially flat side surface 110*a* of the hub structure 110. The accessory tool 430 is formed with a receptacle 432 for snap-fit engagement with the post 130.

In the illustrated embodiment, the second accessory tool 440 is of a multi-tool type which is removably received in a holster-like pocket retention structure 440 formed at a side surface 110*b* of the hub structure 110. The accessory tool 440 is configured to serve an all-around function, from scraping and removing old material and debris from a surface, to smoothing out and neatly shaping beads of sealant or other work material applied by the applicator system 10. Like the first accessory tool 430, this second accessory tool 440 is preferably formed of a strong yet lightweight nonmetallic material. Its elongate profile requires a more substantial structure 140 than the snap-fit post 130 for suitable combination of secure retention and ease of removal for use.

Figure 4:
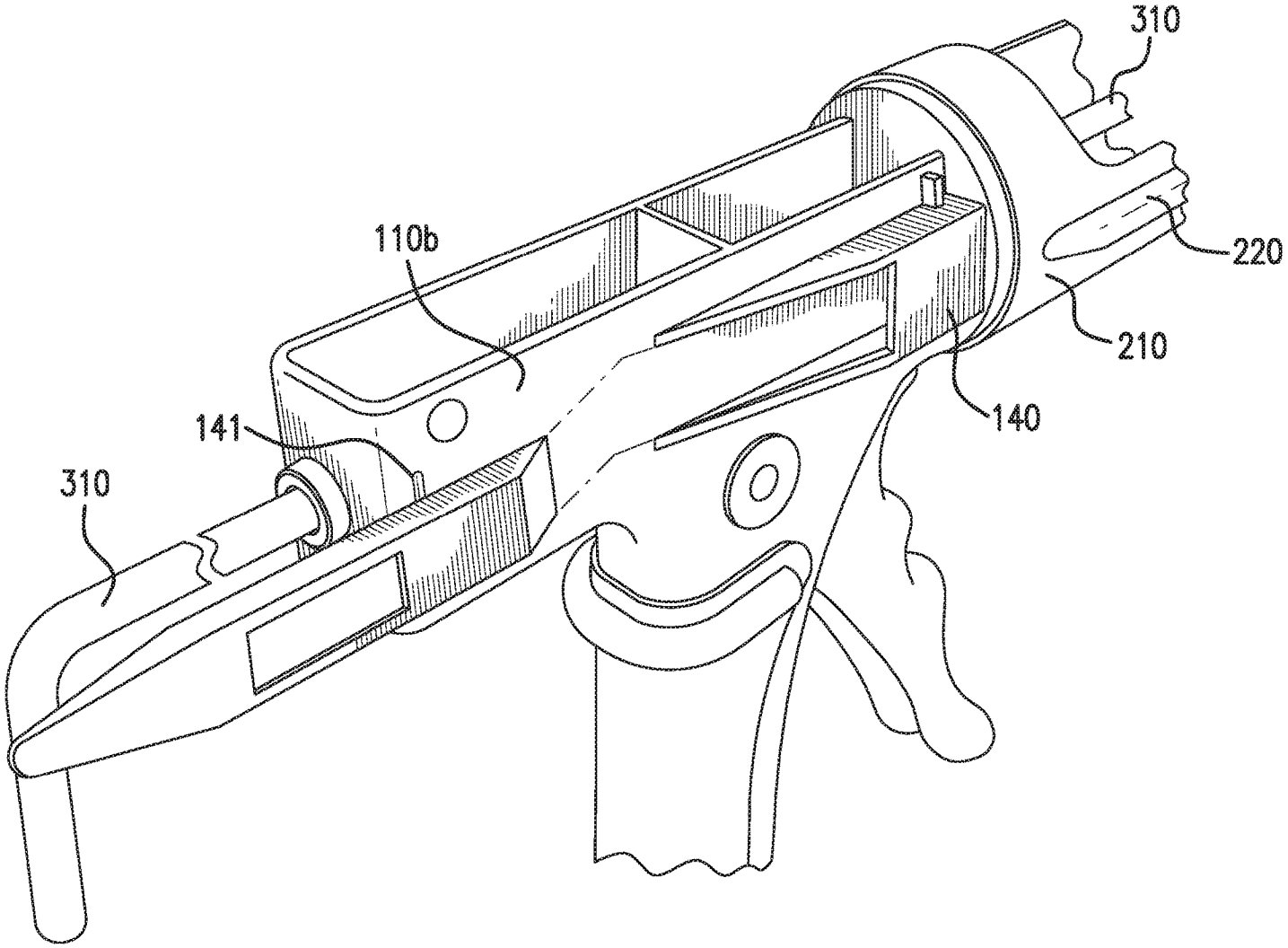
FIG. 4 is an enlarged exploded perspective view of the embodiment as shown in FIG. 2, partially cut away.
Figure 7:
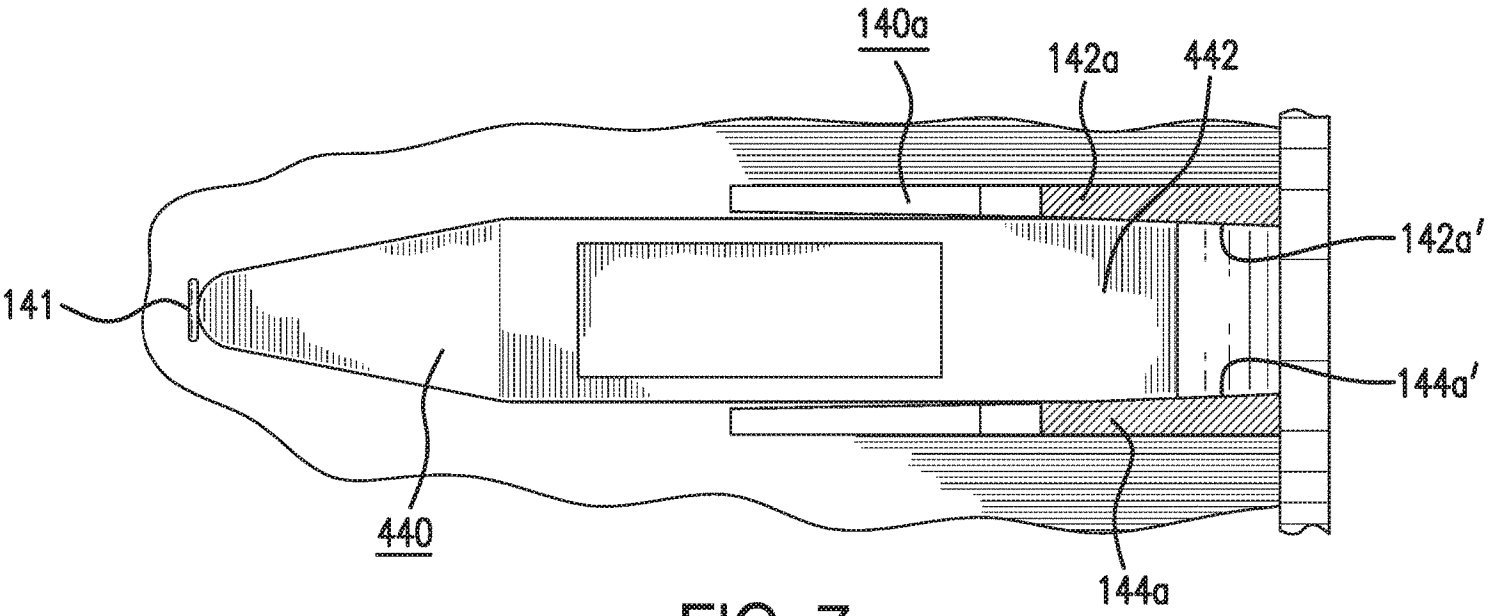
FIG. 7 is a partially sectioned plan view of a portion of the system including a second retention structure and second accessory tool in the embodiment of FIG. 1; and, FIG. 8 is a partially sectioned elevational view of a portion of the system including a second retention structure and second accessory tool as formed in accordance with another alternate embodiment of the present invention.

Accordingly, the holster-like pocket retention structure 140 is formed to define a partially enclosed compartment with an open-mouthed access. As illustrated in FIGS. 4 and 7, the retention structure 140 is formed in the exemplary embodiment shown with an opposed pair of sidewalls 140*a* between which an entry chute extends longitudinally. This entry chute leads to a covered compartment between opposed inner sections 142*a*, 142 of the sidewall which are enclosed by a cover panel extending thereacross. When the accessory tool 440 is fully stowed and properly seated to extend through the entry chute and partially insert into the covered compartment of the retention structure 140. Preferably, a retentive stop member 141 of any suitable structure, such as a simple protrusive nub in the embodiment shown, is also provided on the hub structure surface as a secondary retention measure to guard against tool's unintended escape from the retention structure 140.

The primary retention measure is provided in the force fit retentive engagement between the accessory tool 440 and the inner surfaces of the retention structure 140. As illustrated in FIG. 7, the opposed inner surfaces of the sidewalls 140*a* are gradually tapered to define converging surfaces between which the inner extremity of the accessory tool 440 is captured with increasing force as it advances further into the entry chute, then the covered compartment. The tapering profile is particularly effectual at the inner sections 142*a*, 144*a*, where the tapered wall surfaces 142*a*', 144*a*' tend to apply force fit pressure against the tool's end tip portion captured therebetween. The view shown in FIG. 7 may be slightly exaggerated in this regard to illustrate the minute deflection that occurs in the interfacing materials to accommodate the force fit engagement of the tool and these tapered wall surfaces 142*a*', 144*a*'.

Figure 8:
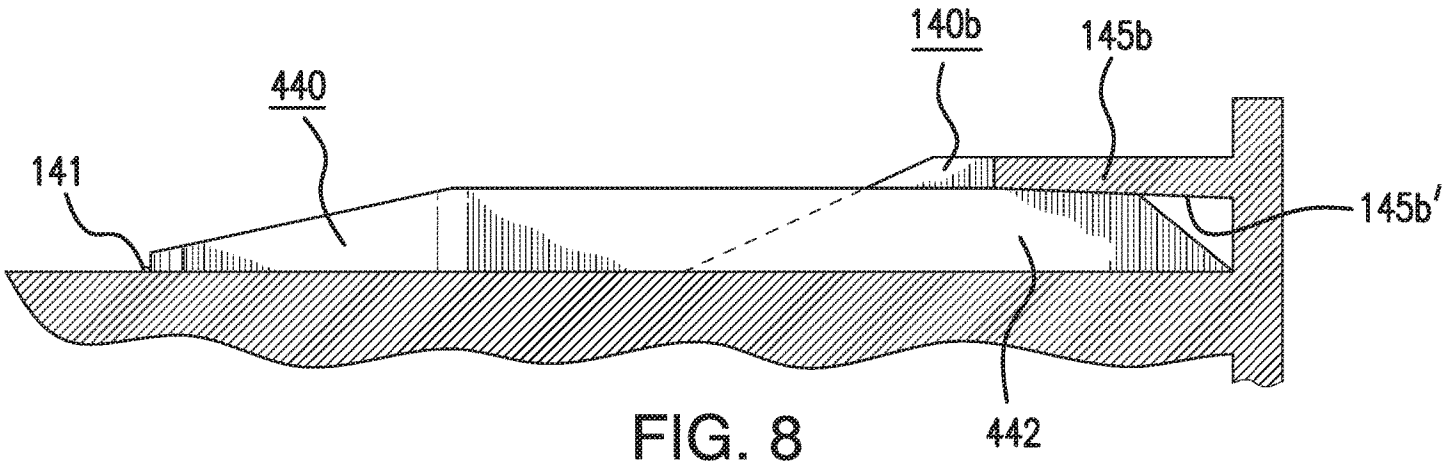

FIG. 8 illustrates replacement or supplemental measures which may be employed in certain embodiments. As shown, the sidewalls 140*b* in those embodiments are covered at their inner sections by a covering panel 145*b* whose inner surface 145*b*' is configured to taper inward to reduce the 'height' of the compartment formed therebeneath. This tapering of the 'overhead' surface 145*b*' increasingly presses down on the end portion of the accessory tool 440 as it is further advanced into the compartment as shown. Depending on the tightness of this force fit engagement, the tapering of side surfaces such as illustrated in FIG. 7 may or may not be needed. In any event, the retention of the accessory tool 440 in its fully stowed position in the pocket retention structure 140 is again preferably reinforced by the retentive stop member 141 formed in this particular embodiment with a smooth speed bump-type profile.

The various portions, parts, and components of the system disclosed herein may be formed of any suitable material known in the art for the particular requirements of the intended applications. Metallic, plastic, rubber, and other such materials are employed in view of such factors as the required combination of strength, rigidity, weight, and the like. The present invention is not limited to any specific choice of such material compositions or their combinations.

Still, in accordance with certain aspects of the present invention, at least the body of the applicator system 10 is preferably formed with modularly assembled components made from one or more lightweight nonmetallic materials known in the art. By way of example, for instance, the hub structure 110 and handle 150 of the handle portion 100, as well as the cage member 210 of the cartridge frame portion 200 in the exemplary embodiment shown may be formed of a polypropylene or other such plastic material. The trigger 170 may be formed of a glass-fiber reinforced thermoplastic material, partially overlaid with a layer of rubber for comfort and grip. Additionally, one or more parts of the handle portion 100 may be provided with a polyamide (nylon) coating. Depending on its configuration and intended function, the accessory tools may be formed for example of a suitable thermoplastic elastomer material (such as for the spreader finishing tool 430 which snaps onto post 130 for stowage), or a polyacetal/polyoxymethylene material (such as for the 'bone' type multi-function tool received in the slotted pocket 140). Where necessary for the particularly intended application, each of the tools 430, 440 may be formed with a suitable degree of flexibility or resilience.

Although this invention has been described in connection with specific forms and embodiments thereof, it will be appreciated that various modifications other than those discussed above may be resorted to without departing from the spirit or scope of the invention as defined in the appended claims. For example, functionally equivalent elements or processes may be substituted for those specifically shown and described, certain features may be used independently of other features, and in certain cases, particular locations of the elements or processes may be reversed or interposed, all without departing from the spirit or scope of the invention as defined in the appended claims.

What is claimed is:

1. An applicator system for efficient extrusive dispensing of work material from a cartridge comprising:

a body including a handle portion and a cartridge frame portion;

said handle portion defining a hub structure, said hub structure including at least first and second retention structures, at least said first retention structure including a receiving post protruding from said hub structure;

said cartridge frame portion including a cage member configured for receiving a cartridge of work material, the cage member being releasably coupled to said hub structure in revolvable manner; and, first and second accessory tools coupled respectively to said first and second retention structures in detachable manner, said first accessory tool being configured for releasable engagement with said receiving post when stowed thereon; and, a drive portion operably coupled to the body, the drive portion including a drive member passing displaceably into the cartridge frame portion for forcing extrusion of work material therefrom;

wherein said handle and cartridge frame portions of said body are formed of one or more predetermined non-metallic materials.

2. The applicator system as recited in claim 1, wherein at least said second retention structure includes a pocket structure for receiving partially enclosed retention of said second accessory tool therein when stowed.

3. The applicator system as recited in claim 2, wherein a retentive stop member is formed on said hub structure displaced from said second retention structure for blocking said second accessory tool from escaping engagement with said second retention structure when stowed.

4. The applicator system as recited in claim 1, wherein said first accessory tool is formed with a receptacle feature configured to receive snap fit insert of said receiving post of said first retention structure therein.

5. The applicator system as recited in claim 2, wherein said pocket structure includes a pair of opposed sidewalls defining an entry chute therebetween, said sidewalls having respective inner sections with a covering panel extending thereacross to define a covered compartment underneath, the covered compartment communicating with the entry chute to receive an end portion of said second accessory tool when stowed.

6. An applicator system for efficient extrusive dispensing of work material from a cartridge comprising:

a body including a handle portion and a cartridge frame portion;

said handle portion defining a hub structure, said hub structure including at least first and second retention structures;

said cartridge frame portion including a cage member configured for receiving a cartridge of work material, the cage member being releasably coupled to said hub structure in a revolvable manner; and, first and second accessory tools coupled respectively to said first and second retention structures in detachable manner, at least said second retention structure including a pocket structure for receiving partially enclosed retention of said second accessory tool therein when stowed, said pocket structure including a pair of opposed sidewalls defining an entry chute therebetween, said sidewalls having respective inner sections with a covering panel extending thereacross to define a covered compartment underneath, the covered compartment communicating with the entry chute to receive an end portion of said second accessory tool when stowed, at least said inner sections of said sidewalls define gradually tapered surfaces to converging surfaces for capturing said end portion of said second accessory tool with increasing force as said second accessory tool is inserted into said covered compartment; and, a drive portion operably coupled to the body, the drive portion including a drive member passing displaceably into the cartridge frame portion for forcing extrusion of work material therefrom;

wherein said handle and cartridge frame portions of said body are formed of one or more predetermined non-metallic materials.

7. An applicator system for efficient extrusive dispensing of work material from a cartridge comprising:

a body including a handle portion and a cartridge frame portion;

said handle portion defining a hub structure, said hub structure including at least first and second retention structures;

said cartridge frame portion including a cage member configured for receiving a cartridge of work material, the cage member being releasably coupled to said hub structure in a revolvable manner; and, first and second accessory tools coupled respectively to said first and second retention structures in detachable manner, at least said second retention structure including a pocket structure for receiving partially enclosed retention of said second accessory tool therein when stowed, said pocket structure including a pair of opposed sidewalls defining an entry chute therebetween, said sidewalls having respective inner sections with a covering panel extending thereacross to define a covered compartment underneath, the covered compartment communicating with the entry chute to receive an end portion of said second accessory tool when stowed, at least said covering panel defining an inner surface gradually tapered into the covered compartment for capturing said end portion of said second accessory tool with increasing force as said second accessory tool is inserted therein; and a drive portion operably coupled to the body, the drive portion including a drive member passing displaceably into the cartridge frame portion for forcing extrusion of work material therefrom;

wherein said handle and cartridge frame portions of said body are formed of one or more predetermined nonmetallic materials.

8. An applicator system for efficient extrusive dispensing of work material from a cartridge comprising:

a body including a handle portion and a cartridge frame portion;

said handle portion defining a hub structure, said hub structure including at least first and second retention structures, said hub structure forming a support surface having a stem projecting longitudinally therefrom and including a shoulder disposed about said stem against said support surface;

said cartridge frame portion including a cage member configured for receiving a cartridge of work material, the cage member being releasably coupled to said hub structure in revolvable manner, said cage member including a bearing plate formed at a rear end and an intermediate section extending longitudinally forward therefrom;

said bearing plate of said cage member being captured against said support surface of said hub structure by a nut washer releasably coupled to said stem;

said nut washer being stopped by said shoulder of said hub structure, said shoulder being dimensioned to maintain clearance for said bearing plate to be captured between said nut washer and said support surface in slidably displaceable manner;

first and second accessory tools coupled respectively to said first and second retention structures in detachable manner; and, a drive portion operably coupled to the body, the drive portion including a drive member passing displaceably into the cartridge frame portion for forcing extrusion of work material therefrom;

wherein said handle and cartridge frame portions of said body are formed of one or more predetermined nonmetallic materials.

9. The applicator system as recited in claim 8, wherein said shoulder is removably disposed about said stem.

10. The applicator system as recited in claim 8, wherein:

one of said nut washer and said support surface defines an annular face having a helically sloped section;

said bearing plate of said cage member includes a protrusive spacer nub formed thereon to engage said annular face when said nut washer is coupled to said stem of said hub structure; and, said cage member being adjusted in tightness of capture between said nut washer and said support surface responsive to angular displacement of said annular face relative to said protrusive spacer nub.

11. An applicator system for efficient extrusive dispensing of work material from a cartridge comprising:

a body including a handle portion and a cartridge frame portion;

said handle portion defining a hub structure, said hub structure having a support surface formed thereon and including at least first and second retention structures, at least said first retention structure including a receiving post protruding from said hub structure;

said cartridge frame portion including a cage member configured for receiving a cartridge of work material, said cage member including a bearing plate formed at a rear end and an intermediate section extending longitudinally forward therefrom, said bearing plate being releasably captured to bear slidably against said support surface of said hub structure, said cage member being thereby coaxially coupled to said hub structure in a revolvable manner; and, first and second accessory tools coupled respectively to said first and second retention structures in detachable manner, said first accessory tool being configured for releasable engagement with said receiving post when stowed thereon; and, a drive portion operably coupled to the body, the drive portion including a drive member passing displaceably into the cage member for forcing extrusion of work material from the cartridge received therein;

wherein said handle and cartridge frame portions of said body are formed with a nonmetallic material composition.

12. The applicator system as recited in claim 11, wherein:

said support surface having a stem projecting longitudinally therefrom and includes a shoulder disposed about said stem against said support surface;

said bearing plate of said cage member is captured against said support surface of said hub structure by a nut washer releasably coupled to said stem; and, said nut washer is stopped by said shoulder of said hub structure, said shoulder being dimensioned to maintain clearance for said bearing plate to be captured between said nut washer and said support surface in slidably displaceable manner.

13. The applicator system as recited in claim 11, wherein said second retention structure includes a pocket structure for partially enclosed retention of said second accessory tool therein when stowed.

14. The applicator system as recited in claim 13, wherein a retentive stop member is formed on said hub structure displaced from said second retention structure for blocking said second accessory tool from escaping engagement with said second retention structure when stowed.

15. The applicator system as recited in claim 11, wherein said cage member is formed with a skeletal configuration defining a substantially tubular profile.

16. An applicator system for efficient extrusive dispensing of work material from a cartridge comprising:

a body including a handle portion and a cartridge frame portion;

said handle portion defining a hub structure, said hub structure including a plurality of retention structures;

said cartridge frame portion including a cage member configured for receiving a cartridge of work material, the cage member being releasably coupled to said hub structure in revolvable manner; and, a plurality of finishing tools coupled respectively to said retention structures in detachable manner, at least one of said retention structures including a pocket structure for partially enclosed retention of one of said finishing tools therein when stowed; and, a drive portion operably coupled to the body, the drive portion including a drive member passing displaceably into the cage member for forcing extrusion of work material from the cartridge received therein;

wherein said handle and cartridge frame portions of said body are formed with a nonmetallic material composition; and, wherein:

said hub structure forms a support surface having a stem projecting longitudinally therefrom and includes a shoulder disposed about said stem against said support surface;

said cage member includes a bearing plate formed at a rear end and intermediate section extending longitudinally forward therefrom;

said bearing plate of said cage member is captured against said support surface of said hub structure by a nut washer releasably coupled to said stem; and, said nut washer is stopped by said shoulder of said hub structure, said shoulder being dimensioned to maintain clearance for said bearing plate to be captured between said nut washer and said support surface in slidably displaceable manner.

17. The applicator system as recited in claim 16, wherein a retentive stop member is formed on said hub structure displaced from said pocket structure of one said retention structure for blocking said finishing tool from escaping engagement therewith when stowed.

18. The applicator system as recited in claim 16, said shoulder is removably disposed about said stem for replacement by an alternative shoulder differing in thickness for adjusting the clearance maintained for the capture of said bearing plate between said nut washer and said support surface.

19. The applicator system as recited in claim 16, wherein:

one of said nut washer and said support surface defines an annular face having a helically sloped section;

said bearing plate of said cage member includes a protrusive spacer nub formed thereon to engage said annular face when said nut washer is coupled to said stem of said hub structure; and, said cage member being adjusted in tightness of capture between said nut washer and said support surface responsive to angular displacement of said annular face relative to said protrusive spacer nub.

* * * * *